US005140964A

United States Patent [19]

Torigai

[11] Patent Number: 5,140,964

[45] Date of Patent: Aug. 25, 1992

[54] FUEL FEED DEVICE FOR INTERNAL COMBUSTION ENGINE

[75] Inventor: Katsumi Torigai, Hamamatsu, Japan

[73] Assignee: Sanshin Kogyo Kabushiki Kaisha, Hamamatsu, Japan

[21] Appl. No.: 705,294

[22] Filed: May 24, 1991

[30] Foreign Application Priority Data

May 24, 1990 [JP] Japan ..... 2-132478

[51] Int. Cl.[5] ..... F02D 41/10; F02B 33/04

[52] U.S. Cl. ..... 123/492; 123/73 A

[58] Field of Search ..... 123/73 A, 478, 480, 123/492, 493

[56] References Cited

U.S. PATENT DOCUMENTS 4,706,632 11/1987 Kasanami et al. ..... 123/492

4,779,598 10/1988 Billingsley et al. ..... 123/492

4,817,571 4/1989 Morita et al. ..... 123/492

4,852,538 8/1989 Nagaishi ..... 123/480

4,917,053 4/1990 Okazaki et al. ..... 123/73 A 4,960,097 10/1990 Tachibana et al. ..... 123/73 A

*Primary Examiner*—Willis R. Wolfe

*Attorney, Agent, or Firm*—Ernest A. Beutler

[57] ABSTRACT

A fuel injection system for a crankcase compression two cycle internal combustion engine wherein the amount of fuel supplied by the fuel injectors is decreased temporarily in the event the engine speed is accelerated after operating at a speed below a predetermined speed for a predetermined length of time. The amount of fuel reduction is determined by the length of time at which the speed has been below the predetermined speed and also the rate of opening of the throttle valve.

14 Claims, 4 Drawing Sheets

FUEL FEED DEVICE FOR INTERNAL COMBUSTION ENGINE

BACKGROUND OF THE INVENTION

This invention relates to a fuel feed device for an internal combustion engine and more particularly to an improved arrangement for supplying fuel and a control therefor under transient conditions.

A wide variety of charge forming systems have been employed for internal combustion engines for supplying their fuel requirements. Such fuel supply systems include carburetors and fuel injectors. Fuel injectors may, in many instances, provide better control for the amount of fuel supplied to the engine, particularly during cycle to cycle operation. However, regardless of the charge forming device employed, the most difficult conditions to satisfy for engine running are transient conditions. That is, when the engine speed or load is changed, the change in fuel requirements of the engine are difficult to accommodate. Although various devices have been employed for providing the appropriate amount of fuel for transient conditions, these systems all have some defects.

For example, a particularly troublesome transient condition is under acceleration. This problem is particularly acute in conjunction with two cycle engines and particularly those wherein the fuel is introduced to the crankcase chamber of the engine before it is delivered to the combustion chamber. When the engine is accelerated, quantities of fuel which may have been accumulated in the induction system will be drawn into the combustion chamber and, coupled with the supply of additional fuel to meet acceleration conditions, cause poor running. This problem is particularly acute when the engine has been operating for a long period of time at a low engine speed and then is accelerated. This condition is particularly prevalent in connection with outboard motors wherein an engine may operate at a low speed for trolling for long periods of time and then be accelerated suddenly.

It is, therefore, a principal object of this invention to provide an improved fuel feed device for an internal combustion engine.

It is a further object of this invention to provide an improved arrangement for controlling the supply of fuel to an engine during acceleration after the engine has been operated at low speeds for long periods of time.

It is a further object of this invention to provide an improved fuel injection system for an internal combustion engine.

It is a further object of this invention to provide an improved fuel injection system for an internal combustion engine, and particularly one operating on the two-stroke crankcase compression principle.

SUMMARY OF THE INVENTION

A first feature of this invention is adapted to be embodied in a fuel injection system for an internal combustion engine that comprises a fuel injector and means for controlling the amount of fuel injected by the fuel injector. Means are incorporated for sensing engine speed and throttle means control the engine speed. In accordance with the invention, means operate the means for controlling the amount of fuel injected by the fuel injector to reduce the amount of fuel delivered for a sensed engine speed, and throttle means condition when the throttle means is operated in a speed increasing direction and if the engine speed was below a predetermined low speed.

A further feature of the invention is adapted to be embodied in a method for operating a fuel injection system as described in the preceding paragraph. In accordance with the method, the amount of fuel injected per cycle is decreased in response to accelerations when the engine has been operating at low speeds for a predetermined time period.

DETAILED DESCRIPTION OF THE PREFERRED EMBODIMENT OF THE INVENTION

Figure 1:
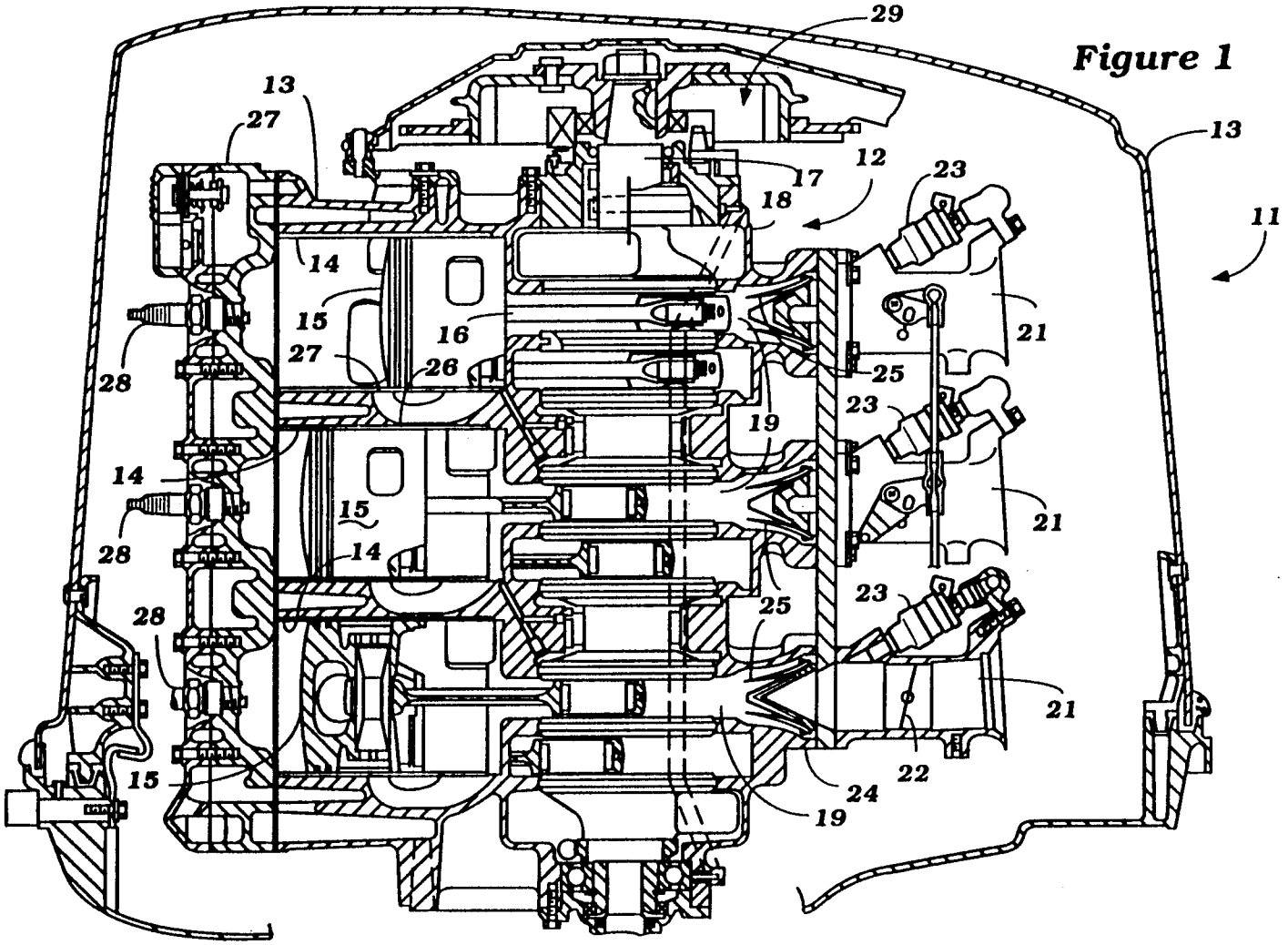
FIG. 1 is a cross-sectional view taken through the power head of an outboard motor constructed in accordance with an embodiment of the invention and having its fuel injection system operated in accordance with an embodiment of the invention.

Referring in detail to the drawings and initially to FIG. 1, a portion of the power head of an outboard motor, indicated generally by the reference numeral 11, is illustrated. The invention is described in conjunction with an outboard motor inasmuch as the invention has particular utility in two cycle crankcase compression internal combustion engines. However, it is to be understood that the invention can be practiced in conjunction with other applications for two cycle engines of this type and, furthermore, can be employed with engines operating on other cycles including four-stroke cycle engines.

The power head of the outboard motor 11 includes a powering internal combustion engine, indicated generally by the reference numeral 12, and a surrounding protective cowling 13. The engine 12 is, in the illustrated embodiment, of the V-6 type and, as aforenoted, operating on the two-stroke principle. In addition to being applicable to engines other than two-stroke engines, the invention also may be employed with engines having any numbers of cylinders or, in fact, engines other than reciprocating engines.

The engine 12 includes a cylinder block 13 having angularly disposed banks in which cylinder bores 14 are formed. The cylinder bores 14 slidably support pistons 15 which are connected by means of connecting rods 16 to a crankshaft 17 that is journaled for rotation about a vertically extending axis, as is typical with outboard motor practice. This rotatable support for the crankshaft 12 is provided by the cylinder block 13 and a crankcase member 18 which is affixed in a suitable manner to the cylinder block 13.

Individually sealed crankcase chambers 19 are formed in the crankcase in a known manner and each chamber 19 is associated with one of the cylinder bores 14, as is typical with two cycle engine practice.

A charge of fuel and air is supplied to the chambers 19 by throttle bodies 21 in which throttle valves 22 are positioned. The throttle bodies 21 draw air from within the protective cowling 13 through a suitable air silencing device (not shown). Individual electrically operated fuel injectors 23 are provided in each of the throttle bodies 21 and spray a fuel charge into the intake air in a manner controlled as will be described. This intake air and fuel charge is then delivered to the crankcase chambers 19 through an intake manifold 24 in which reed-type check valves 25 are positioned. The check valves 25 insure that there will not be reverse flow from the crankcase chambers 19 back into the induction system, as thus far described, when the charge is being compressed.

The fuel air charge drawn into the crankcase chambers 13 during the upward movement of the pistons 15 within the cylinder bores 14 is compressed as the pistons 15 move downwardly and then is transferred to the area above the heads of the pistons 15 through scavenge passages 26 formed in the cylinder block 13 and which terminate in scavenge ports 27 extending through the cylinder bores 14. This charge enters a combustion chamber formed between the heads of the pistons 15, the cylinder bores 14 and a cylinder head assembly 27 that is affixed to the cylinder block 13 in a well known manner. Individual spark plugs 28 are mounted within the cylinder head 27 and fire the charge in the combustion chambers via an ignition system which includes a flywheel magneto 29 that is affixed to the upper end of the crankshaft 17 in a known manner.

Figure 2:
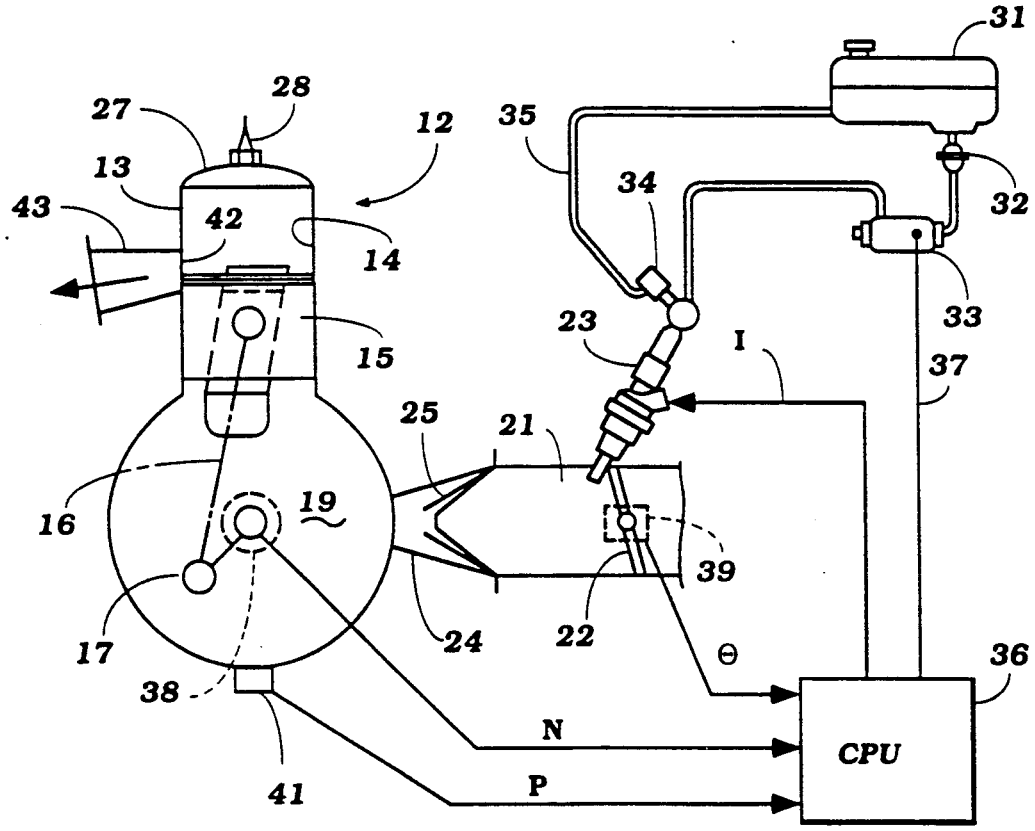
FIG. 2 is a schematic view showing the engine and the fuel injection system and associated control therefor.

The system which supplies fuel to the fuel injectors 23 and which controls their operation is shown schematically in FIG. 2 and will now be described by particular reference to that figure. This fuel system includes a fuel storage tank 31 which may be positioned externally of the outboard motor 11 and contained within the hull of an associated watercraft, as is well known in this art. Fuel is drawn from the fuel tank 31 through a fuel filter 32 by means of a high pressure fuel pump 33. This fuel is then delivered to a pressure regulator 34 associated with the manifolding that supplies fuel to the individual fuel injectors 23. A constant head of fuel pressure is maintained by the pressure regulators 34 by bypassing excess fuel back to the fuel tank 31 through a return conduit 35.

The fuel injectors 23 may be of any known type and preferably are electronically controlled so as to open and close in response to a control signal I transmitted to the electronic portion of the fuel injectors 23 from a CPU 36. The CPU 36 also controls the operation of the fuel pump 33 through a suitable conductor 37. The CPU receives certain signals indicative of engine operating conditions so as to provide the appropriate timing and duration of fuel injection from the injectors 23.

Although a wide variety of signals may be employed, in conjunction with the invention, there is provided at least an engine crankshaft rotatable speed and angular position sensor 38 that outputs a signal N indicative of speed and angular position to the CPU 36. In addition, there is provided a throttle valve position sensor 39 which senses the positions of the throttle valves 22 and outputs a throttle valve position signal $\theta$ to the CPU 36. In addition to these aforenoted signals, a wide variety of other ambient or running condition signals may be supplied to the CPU 36 depending upon its fuel control strategy. In the illustrated embodiment, the remaining signal supplied to the CPU 36 is the pressure signal P sensed by a sensor 41 within the crankcase chambers 29. It has been found that the pressure signal P is indicative of the load and speed of the engine.

The fuel air charge which has been admitted to the combustion chambers and fired by the spark plugs 16 is then discharged from the cylinders through exhaust ports 42 into an exhaust manifold 43 for discharge to the atmosphere through an appropriate exhaust system. As is typical with outboard motor practice, this exhaust system may include a silencing arrangement contained within the driveshaft housing (not shown) of the outboard motor 11 and an underwater high speed exhaust gas discharge.

The construction of the engine and the fuel injection system for it as thus far described may be considered to be conventional. For that reason, reference may be had to any known prior art type of constructions for the details of the components with which the invention may be utilized. However, in conjunction with the prior art type of systems there is a problem with providing proper fuel/air mixture to the engine under a specific transient condition, namely, acceleration after operating at low speeds for a long period of time. It is common for outboard motors to operate at low speeds during long periods of time during trolling. However, when the engine is accelerated rapidly after such a long low speed operation, improper engine performance results with the prior art type of constructions. The reason for this is that fuel tends to accumulate in the induction system for the engine during these low speed running periods. When the speed of the engine increases, the increased flow through the induction system tends to pick up the fuel that has been deposited in the induction system and deliver it to the combustion chambers. This results in an over rich mixture which results not only in poorer performance but also in poor fuel economy and high exhaust gas emissions.

In accordance with the invention, a means is incorporated in the CPU 36 so as to diminish the amount of fuel supplied by the fuel injectors 23 during each cycle under the acceleration phase after a predetermined time period of low speed operation so as to compensate for this additional fuel delivered through the pick up from the deposits in the induction system. In this way, engine performance, fuel economy and exhaust emission control can all be improved.

The way the system operates is basically to determine for a given condition of the engine the appropriate amount of fuel to be injected. This is set by setting a time T during which the injector 23 receives the signal I so as to cause it to discharge. By varying the time T of injection, the amount of fuel injected can be varied. The set running conditions for determining the initial setting of fuel injection time T are the instantaneous pressure signal P derived from the sensor 41, the engine crankshaft speed N derived from the sensor 38, and the throttle opening angle $\theta$ determined by the throttle position sensor 39. In addition, the timing of fuel injection beginning can be varied in accordance with any desired program. The basic program for determining the time T can be any of those well known in this art.

Figure 3:
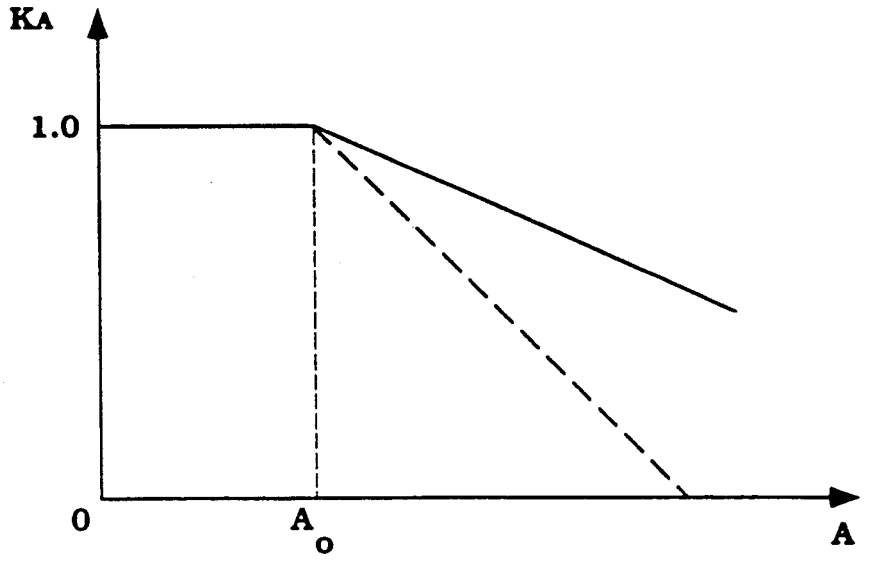
FIG. 3 is a graphical view showing the selection of the constant factor $K_A$ in relation to the time A when the engine has been operating at a speed lower than a predetermined speed.

In accordance with the invention, however, there is also measured a time A during which the engine speed is below a predetermined relatively low speed, such as a trolling speed for an outboard motor. There is then generated a constant $K_A$ for adjusting the fuel injection time T when the engine has been held at a speed below the predetermined speed for more than a predetermined time period. This constant $K_A$ is derived from a curve as the curve of FIG. 3 wherein the time $A_O$ is the minimum time at which the engine speed operates below the predetermined speed before an adjustment is made. The time $A_O$ can depend upon a variety of factors and primarily those dealing with the basic engine configuration.

Figure 4:
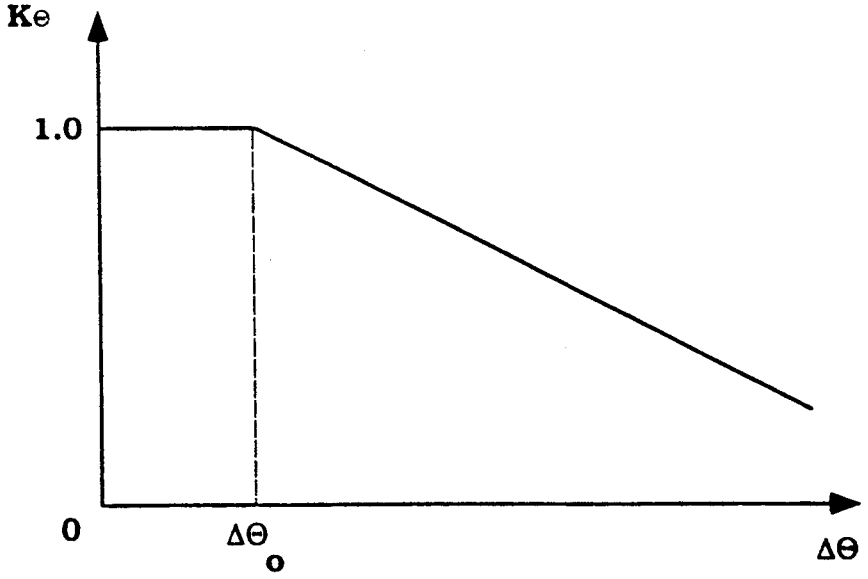
FIG. 4 is a graphical view showing the constant $K_\theta$ for variations in throttle opening $\Delta\theta$.

In addition to the corrective $K_A$, there is also applied a further corrective factor $K_\theta$ which reduces the amount of fuel supplied when the throttle valve 22 has been opened at a greater than a predetermined rate in a given time. This corrective factor is shown by the curve of FIG. 4 and when the change of throttle opening $\Delta\theta$ is greater than this amount, ($\Delta\theta_O$) then the corrective factor is reduced so as to reduce the amount of fuel supplied per injection cycle.

Figure 5:
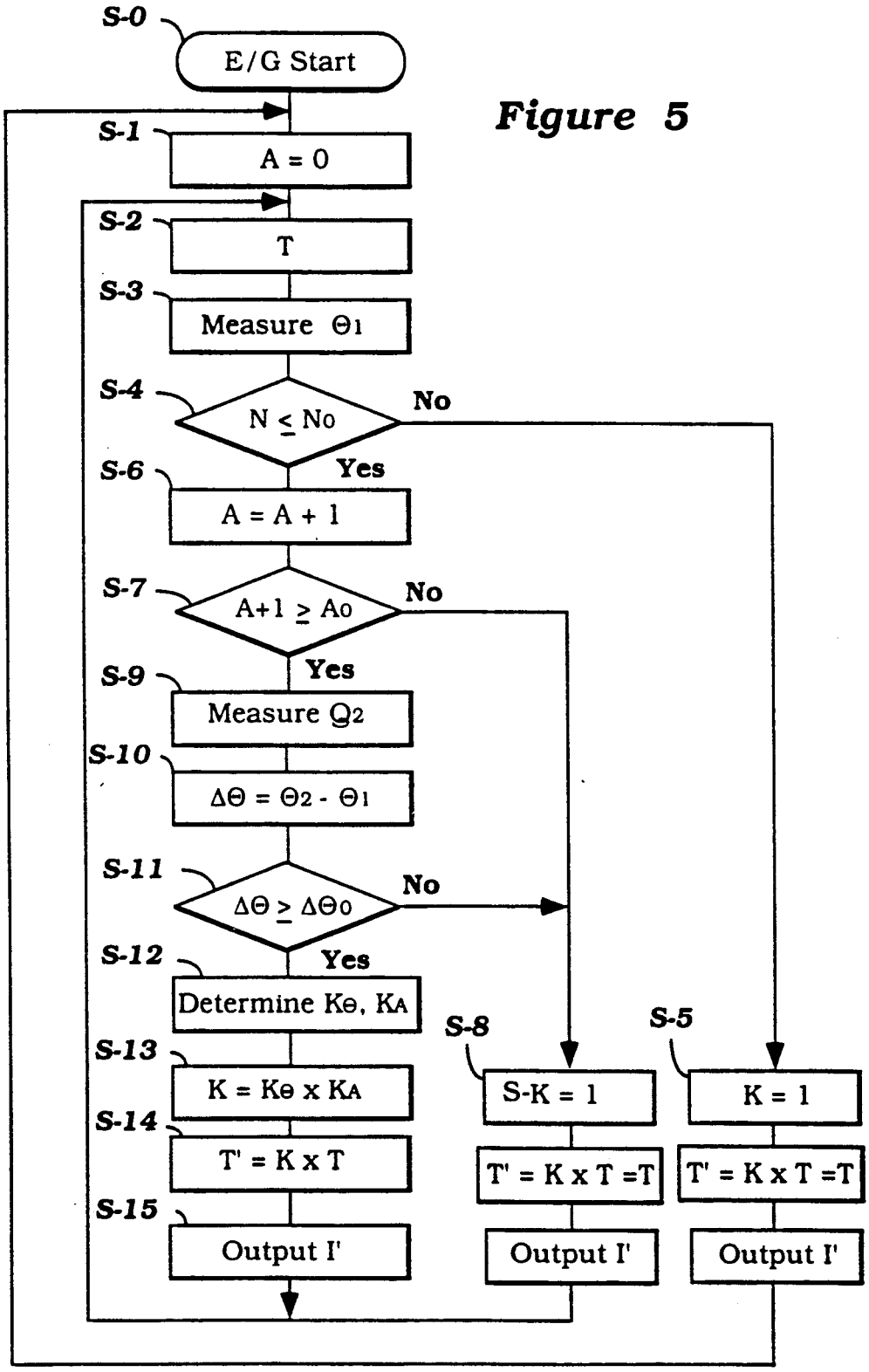
FIG. 5 is a block diagram showing the control routine.

The control routine may be understood best by reference to FIG. 5. At the start step S-0, the program begins and moves to the step S-1 to reset the time counter A to zero (A=0). The program then moves to the step S-2 to set the fuel injection time T for the engine characteristics determined by the rotational speed N of the crankshaft 17 and the pressure P within the crankcase chamber 19 and the throttle valve opens $\theta$. The program then moves to the step S-3 to measure the instantaneous throttle valve position $\theta_1$. Then the program moves to the step S-4 to determine if the engine speed N is equal to or below the predetermined engine speed $N_O$ at which fuel injection amount may be require adjustment under rapid throttle opening conditions.

If at the step S-4 it is determined that the engine speed N is not equal to or less than the predetermined speed $N_O$, the program moves to the step S-5 so as to set the constant K equal to 1 and then the fuel injection amount T' is calculated by the equation $T'=K\times T=T$. An output signal I' is then given to the fuel injector 23 so as to cause normal fuel injection duration for the sensed running condition of the engine.

If, however, it is determined at the step S-4 that the engine speed is equal to or below the engine speed $N_O$ at which an adjustment in the fuel injection amount may be required if the throttle is opened rapidly, the program moves to the step S-6 where the counter is advanced one unit so that $A=A+1$. The program then moves to the step S-7 to determine if the product of the step S-6 is greater than the predetermined time period $A_O$at which fuel injection amount needs correction. That is, if the engine has been operating below the speed $N_O$ for a time period greater than the time period $A_O$, then the adjustment in the fuel amount injected will be required. If it is determined at the step S-7 that the time period $A_O$ has not been equalled or exceeded, the program moves to the step S-8 so as to again set the fuel injection amount. At the step S-8 it is determined that the constant K can be set at 1 and the fuel injection amount T' then equals $K\times T=T$. This output signal I' is then given to the injector 23 so as to inject the normal fuel amount for the time period T. At the ends of the steps S-5 and S-8, the program repeats back to the step S-2 as shown in FIG. 5.

If, at the step S-7, it has been determined that the engine speed has been below the engine speed $N_O$ for a greater time period than the time $A_O$, then the program moves to the step S-9 to again measure the throttle position $\theta 2$. At the step S-10 there is made a comparison between the throttle positions $\theta 2$ and $\theta 1$ to determine a difference $\Delta\theta$, which is indicative of the rate of throttle valve opening since this measures the amount of throttle valve opening increase in a given time period as determined by the counter. The program then moves to the step S-11 to determine if $\theta$ is greater than $\Delta\theta_O$, the throttle opening rate at which fuel adjustment may be required.

If, at the step S-11, it is determined that the throttle opening $\Delta\theta$ is not greater than the throttle opening at which fuel adjustment is required $\Delta\theta_O$the program exits to the step S-8 and again sets the standard fuel injection amount. If, however, the difference in throttle opening is greater than $\Delta\theta_O$ the program moves to the step S-12 to determine the coefficient factors $K_\theta K_A$by reference to the graphs of FIGS. 3 and 4 which are preprogrammed into the CPU 36. The slope of these curves may vary with basic engine parameters as seen by the broken line curve in FIG. 3.

The program then moves to the step S-13 so as to set the corrective constant K by the equation $K=K_\theta\times K_A$ and then at the step S-14 sets the fuel injection timing T' by the equation $T'=K\times T$. The modified output signal I' thus determined is then outputted at the step S-15 to the injector 23 so as to provide the adjusted injection timing so as to avoid the deleterious running characteristics aforenoted when the engine is accelerated after operating at a predetermined low speed for more than an predetermined time.

From the foregoing description it should be readily apparent that the system is highly effective in providing good running conditions even during the difficult period when the engine is accelerated rapidly after operating at low speeds for long periods of time. Of course, the described control routine and sensed parameters are only a preferred embodiment of the invention and various changes and modifications may be made without departing from the spirit and scope of the invention, as defined by the appended claims.

I claim:

1. A fuel injection system for an internal combustion engine comprising a fuel injector, means for controlling the amount of fuel injected by said fuel injector, means for sensing engine speed, throttle means for controlling engine speed, and means for operating said means for controlling the amount of fuel injected by said fuel injector to reduce the amount of fuel delivered for a sensed engine speed and throttle means condition from the amount called for solely by the speed and throttle means position when said throttle means is operated in a speed increasing direction and if said engine speed was previously below a predetermined engine speed.

2. A fuel injection system as set forth in claim 1 wherein the means for operating the means for controlling the amount of fuel injection reduces the amount of fuel delivered only when the engine speed has operated below the predetermined engine speed for more than a predetermined amount of time.

3. A fuel injection system as set forth in claim 2 wherein the amount of fuel reduction is increased as the time at which the engine has operated below the predetermined speed is increased.

4. A fuel injection system as set forth in claim 1 wherein the amount of fuel supplied is reduced only if the throttle valve is moved in the increasing speed direction at a greater than predetermined rate.

5. A fuel injection system as set forth in claim 4 wherein the amount of fuel reduction is increased as the rate of speed increasing movement of the throttle means increases.

6. A fuel injection system as set forth in claim 5 wherein the means for operating the means for controlling the amount of fuel injection reduces the amount of fuel delivered only when the engine speed has operated below the predetermined engine speed for more than a predetermined amount of time.

7. A fuel injection system as set forth in claim 6 wherein the amount of fuel reduction is increased as the time at which the engine has operated below the predetermined speed has increased.

8. A method of operating a fuel injection system for an internal combustion engine comprising a fuel injector, means for controlling the amount of fuel injected by said fuel injector, means for sensing engine speed, and throttle means for controlling engine speed comprising the step of operating the means for controlling the amount of fuel injected by the fuel injector to reduce the amount of fuel delivered for a sensed engine speed and throttle means condition from the amount called for solely by the speed and throttle means position when the throttle means is operated in a speed increasing direction and if said engine speed was previously below a predetermined engine speed.

9. A method as set forth in claim 8 wherein the amount of fuel delivered is reduced only when the engine speed has operated below the predetermined engine speed for more than a predetermined amount of time.

10. A method as set forth in claim 9 wherein the amount of fuel reduction is increased as the time at which the engine has operated below the predetermined speed is increased.

11. A method as set forth in claim 8 wherein the amount of fuel supplied is reduced only if the throttle valve is moved in the increasing speed direction at a greater than predetermined rate.

12. A method as set forth in claim 11 wherein the amount of fuel reduction is increased as the rate of speed increasing movement of the throttle means increases.

13. A method as set forth in claim 12 wherein the amount of fuel delivered is reduced only when the engine speed has operated below the predetermined engine speed for more than a predetermined amount of time.

14. A method as set forth in claim 13 wherein the amount of fuel reduction is increased as the time at which the engine has operated below the predetermined speed is increased.

* * * * *